US006109266A

United States Patent [19]

Turchetti

[11] Patent Number: 6,109,266

[45] Date of Patent: Aug. 29, 2000

[54] MOUTHGUARD AND MOUTH-PIECE FOR THE PREVENTION OF ORO-MAXILLOFACIAL TRAUMAS DERIVING IN PARTICULAR FROM SPORT ACTIVITIES

[75] Inventor: Mauro Turchetti, Saronno, Italy

[73] Assignee: Quattroti Dentech S.A.S. di Turchetti Mauro E.C., Milan, Italy

[21] Appl. No.: 09/069,901

[22] Filed: Apr. 30, 1998

[30] Foreign Application Priority Data

Apr. 30, 1997 [EP] European Pat. Off. ..... 97830202

[51] Int. Cl.[7] ..... A61C 5/14

[52] U.S. Cl. ..... 128/861; 128/862

[58] Field of Search ..... 128/846, 848, 128/859–862

[56] References Cited

U.S. PATENT DOCUMENTS

| | | | |
|---|---|---|---|
| 2,521,039 | 9/1950 | Carpenter | 128/861 |
| 3,250,272 | 5/1966 | Greenberg | 128/862 |
| 3,768,465 | 10/1973 | Helmer | 128/862 |
| 4,955,393 | 9/1990 | Adell | 128/859 |
| 5,152,301 | 10/1992 | Kittelsen | 128/861 |

*Primary Examiner*—Michael A. Brown
*Attorney, Agent, or Firm*—Dvorak & Orum

[57] ABSTRACT

An anatomical mouthmember for the prevention of oro-maxillo-facial traumas, resulting in particular from sporting activities, as a mouthguard or a mouthpiece comprise at least one cavity for housing a dental arch, which cavity is bounded by a base wall of controlled thickness and by side walls which are connected to the base wall, are anatomically preformed and are shaped with a profile complementing the shape of the average surface of the natural teeth and gums of a statistically predetermined set of individuals. (FIG. 3)

19 Claims, 2 Drawing Sheets

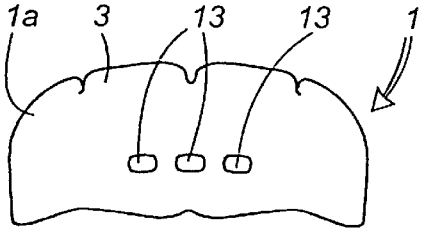
FIG. 4
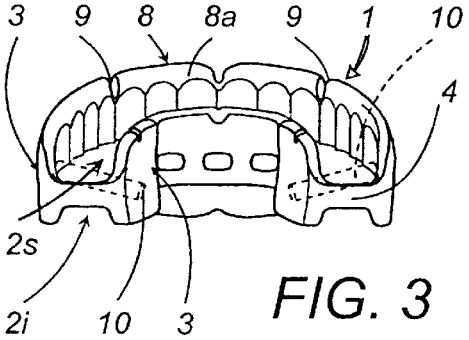
FIG. 3
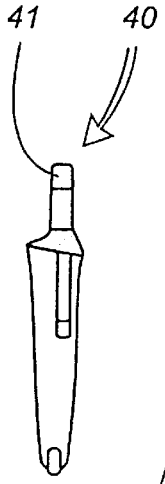
FIG. 5b
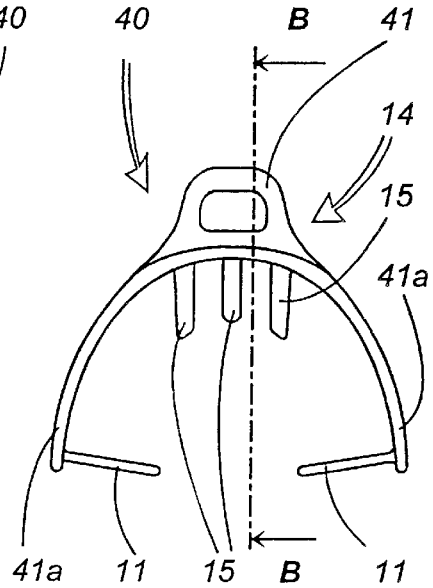
FIG: 5a
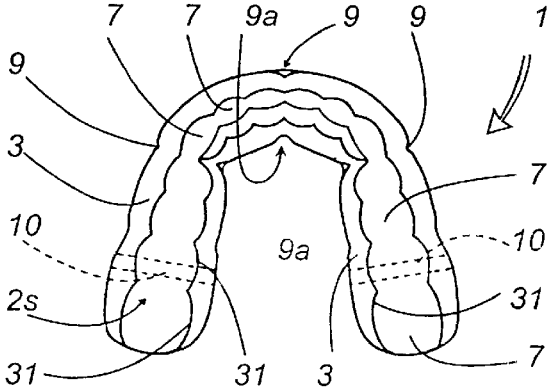
FIG. 1
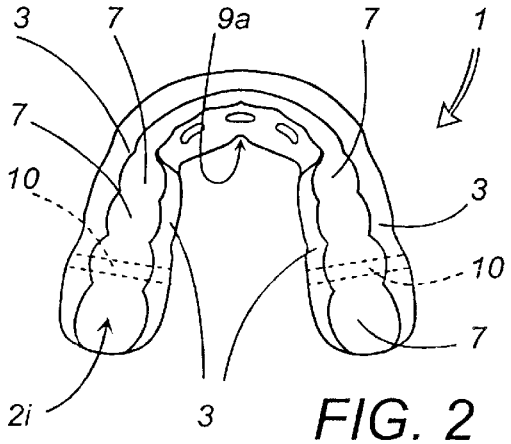
FIG. 2
FIG. 6
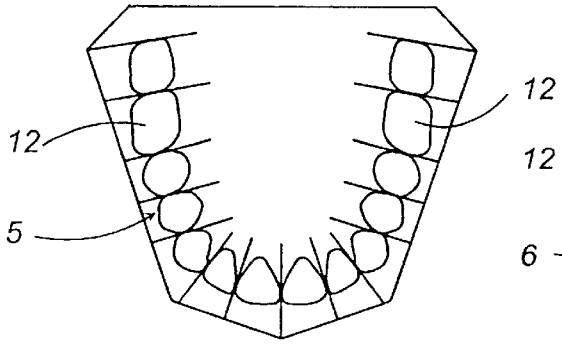
FIG. 7
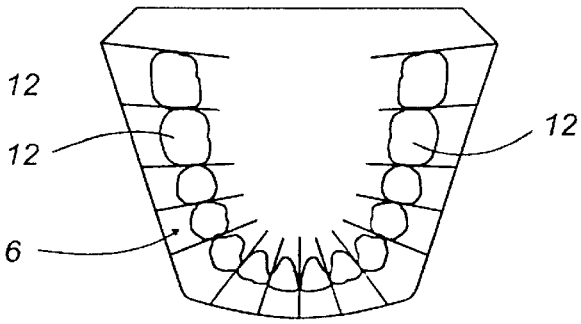

MOUTHGUARD AND MOUTH-PIECE FOR THE PREVENTION OF ORO-MAXILLOFACIAL TRAUMAS DERIVING IN PARTICULAR FROM SPORT ACTIVITIES

BACKGROUND OF THE INVENTION

The present invention relates to a mouthmember as a mouthguard for the prevention of oro-maxillo-facial traumas deriving in particular from sporting activities and to an anatomical intra-oral mouth-piece incorporating the mouthguard.

Sport activity, normally a source of physical and psychic well-being, may occasionally cause a series of traumas to the athlete which, if not adequately prevented, may force him or her to long and costly rehabilitative therapies resulting in his/her temporary, or in the worst cases permanent, discontinuation of the sporting activity.

Oro-maxillo-facial traumas to which the present invention particularly relates, are associated to numerous sports. Some of them entail physical contact, such as boxing, rugby, football, martial arts; others, such as handball, basketball, skiing, tennis, cycling, though they do not entail physical contact, are nonetheless interested in the prevention of such traumas, as is unfortunately confirmed by the most up-to-date injury statistics.

The clinical documentation available in the literature confirms that very many athletes pay a high tribute to their sport in terms of injuries deriving from mandibular fractures, fractures of tooth crowns and roots, pulpal lesions and tooth avulsion or dislocation.

To the physical injury is also connected a large economic damage, correlated to the cost of the therapeutic and rehabilitative services, whose costs are very frequently borne by the community, where health legislation specifically provides for it.

In order to prevent traumas to the dental apparatus, dentistry specialists and sporting goods manufacturers supply endo-oral devices made of rubber-like materials, internationally known as "mouthguards".

The requirements a mouthguard has to meet in order to perform its protective function are many and generally known from the specialist literature of the sector.

Some such requirements are to isolate lips from teeth, to protect the upper teeth against direct hits, to mitigate or eliminate biting contacts, to keep maxillaries close together and to be adequately resilient. Additionally, the mouthguard has to allow the athlete to breathe through the mouth with maxilliaries shut, easily to swallow saliva and to speak in team sports. Lastly, protection has to be stable and retentive, and it has to integrate in the stomatologic system with no iatrogenic effect.

Ttwo categories of mouthguards are currently known: a first category is represented by mouthguards manufactured according to the user's personal morphology; the second category is instead represented by generically shaped mouthguards, manufactured in series with industrial methodologies and marketed in sporting goods shops.

Individual mouthguards are pressed on the printed of the individual's upper and lower dental arches and perfectly cover the dental crowns and the gum. Since they are modelled in a way that is wholly similar to a dental prosthesis, their design strictly corresponds to the athlete's anatomy, their size is calibrated and they guarantee an excellent protective function, a high in-situ stability and good comfort during their use.

Their usage, however, is extremely limited, due to the fact that the athlete needs the work of prosthetic specialists, has to undergo a rather long procedure for the preparation of the mouthguard and has to face a large expense.

A first type of series-produced (and therefore low price) mouthguard is represented by a ready to use product which is usually marketed in three standard sizes and which the athlete can wear immediately after purchasing it. This mouthguard has a generic and unchanging shape and adapts only coarsely to the athlete's specific anatomy: thus in most cases it is found to be unstable and awkward, it requires to be kept in place by constant biting and it interferes with speaking and breathing. Since this product is not retentive, its protective function is very limited and, whenever biting problems also exist, the medical/dental literature strongly recommends against their use.

A second type of industrially produced mouthguard, which is currently the most widely used because it is more comfortable than the previous one, though still inexpensive, is represented by a type made of thermoplastic material which can be immersed in boiling water and shaped by the athlete in his/her mouth using his/her fingers, tongue and biting pressure. Available in standard packages of a few different sizes, these mouthguards often lack an adequate extension and thickness. The marked reduction in occlusal thickness (70 to 99% of the initial thickness) that occurs during the adaptation phase, i.e. when the athlete bites the mouthguard uncontrolledly, entails a noticeable reduction in protective capacity, which is revealed in a particularly severe way in case of a hit to the chin. Under such conditions, the insufficient size of the space located between the athlete's upper and lower dental arches can be responsible for cranial and cerebral pressures with highly dangerous consequences.

Therefore, although this mouthguard is advantageous from the point of view of cost and is widely available on the market, it nonetheless affords insufficient protection against one of the most dangerous and severe traumas.

Wholly similar problems to the ones exposed above are found within the field of intra-oral anatomical mouth-pieces, of the kind which can be personalised, currently employed in breathing apparatuses for underwater sports.

The aforesaid mouth-pieces, as is well known, are made of rubber-like material and comprise an air (or oxygen) manifold, a retention element and two support inserts.

The manifold is the part that firmly connects the retention element to the breathing apparatus. The retention element is placed between lips and teeth and it has a hole to allow air passage. The support inserts extend intra-orally interposing themselves between the dental arches, so as to provide the diver with a gripping area which he/she can bite on, thus holding the mouthpiece stably in position.

Currently produced mouthpieces are also divided in two categories: a standard, ready to use type, and a type which can be personalised (with hot water) by virtue of the material it is made of. As for mouthguards, their shape does not correspond to the anatomy of the oro-dental apparatus. In particular, it can be noted that the design of the retention element profile, which does not take into account the backward position of the mandible with respect to the maxilla, forces the user to a slight protrusion of the mandibular position taking it to an aphysiological position which, coupled with the shape and size of the support areas, not calibrated according to the individual's anatomic design, force the athlete continually to shut his/her teeth together to hold the mouth-piece in place. These continual movements cause the retention element to rub against the gum with friction, resulting in injuries to the oro-dental apparatus.

Numerous pathological situations may arise as a consequence of the prolonged use of these types of mouth-pieces. Among them, the following have been observed: dysfunctions of the temporo-mandibular articulation with articular and muscular repercussions (pains) caused by a poor distribution of the occlusal load on the dental elements, which also aggravates any parodontal lesions which may be present; gingivitis caused by the continual rubbing of the retention element on the gums, due to the instability of the device. Moreover, the mouth-piece also hampers deglutition and therefore the opening of the Eustachian tubes, necessary for middle ear balance, causing the feeling that one's ears are occluded, and occasionally even leading to disorientation and vertigo.

SUMMARY OF THE INVENTION

A purpose of the present invention is therefore to provide a pre-formed, series producible, low cost mouthguard, able to carry out a protective function comparable to that provided by a made-to-measure mouthguard which, by contrast, today is economically prohibitive for most athletes. According to the invention, this goal is reached by a mouthguard for the prevention of oro-maxillo-facial traumas, of the type comprising at least one cavity housing a dental arch, which cavity is bounded by side walls connected to an intermediate base wall, where said one or each cavity is anatomically preformed at least in correspondence with its side walls, the latter being shaped with a profile that is complementary at least to the shape of the average surface of the natural teeth of a statistically predetermined set of individuals.

The shape of the cavities is designed to conform with the shape of the teeth and it is provided with alveoli able individually to house each of the teeth.

Since the cavity is so shaped as to encompass the average profiles of a broad group of individuals, a mouthguard produced according to the invention, though designed with a standard shape, is easy to adapt, self-retentive in place, and effectively protective for large groups of athletes. The capability of remaining spontaneously in place, presented by the mouthguard, affords the additional advantage of freeing the athlete from the need to keep his/her teeth tightly shut when using the mouthguard. This feature, in addition to the advantage of a more comfortable and less fatiguing use of the mouthguard, also allows the athlete to keep the mandible in the natural condition of muscle relaxation which, as is well known, represents the most anatomically correct condition to maintain also while practicing a sport, with very particular exceptions.

If the mouthguard is also produced in thermoplastic material, personalisation can be taken by the user to a high degree of adaptation to the anatomic shape of his/her own mouth, with no additional costs and with no need for specialistic interventions.

Moreover, the invention also comprises a limiter device by means of which the user can control, during the personal isation phase and with no chance for errors, the attainment of the most suitable occlusal space. This also affords the additional advantage of a practical impossibility of reducing the occlusal thickness to lower values than those necessary for maximum protective effectiveness.

The limiter device, being able rigorously to control the size of the occlusal thickness, provides the additional advantage of modulating such thickness according to the various needs. This thickness can be reduced, for instance, for mouthguards to be used when engaged in sports which, by their nature, entail a lower risk of specific injury. In other cases, it may be suited to particular needs of the athletes: for example, one can consider bruxist athletes who, under the effect of the nervous tension induced by the sporting activity, unconsciously tend to tighten and gnash their teeth developing such a friction as to cause cracks, fissures and erosions in the tooth enamel.

An additional purpose of the invention is to provide a mouthpiece able to prevent the pathological situations related to mouthpieces known in the art, by means of a personalisation which is anatomically correct with respect to the user's intra-oral structure.

According to the invention, this purpose is achieved by means of a mouthpiece so formed as to integrate in its structure a mouthguard according to the invention.

Among the advantages of the mouthpiece according to the invention are: a dimensioning of the vertical thicknesses of the mouthpiece which corresponds to the user's individual physiological position an adequate partition of the occlusal forces with relief to muscle structures and absence of pains; a high stability of the device which minimises rubbing by the retention element against the gum when the mouthpiece is in use. The technical characteristics of the invention, according to the aforesaid purposes, can be clearly seen from the content of the claims reported below, and its advantages shall be made more evident in the detail description which follows, made with reference to the attached drawings, which represent an embodiment provided purely by way of non limiting example.

BRIEF DESCRIPTION OF THE DRAWINGS

FIG. 1 is an overall representation of a mouthguard according to the invention, shown in plan top view;

FIG. 2 is an overall representation of a mouthguard according to the invention, shown in plan bottom view;

FIGS. 3 and 4 are a rear view and a front view of the mouthguard as per the previous figures;

FIGS. 5*a* and 5*b* are a plan view and a side view, sectioned along the line B—B, of a device which can be associated to the mouthguard as per the previous figures to control the occlusal thickness during the personalisation phase;

FIGS. 6 and 7 are plan views of the upper and lower dental arches of an individual, to which are associated the different parts of the mouthguard shown in FIGS. 1 and 2;

DESCRIPTION OF THE PREFERRED EMBODIMENTS

Figure 9:
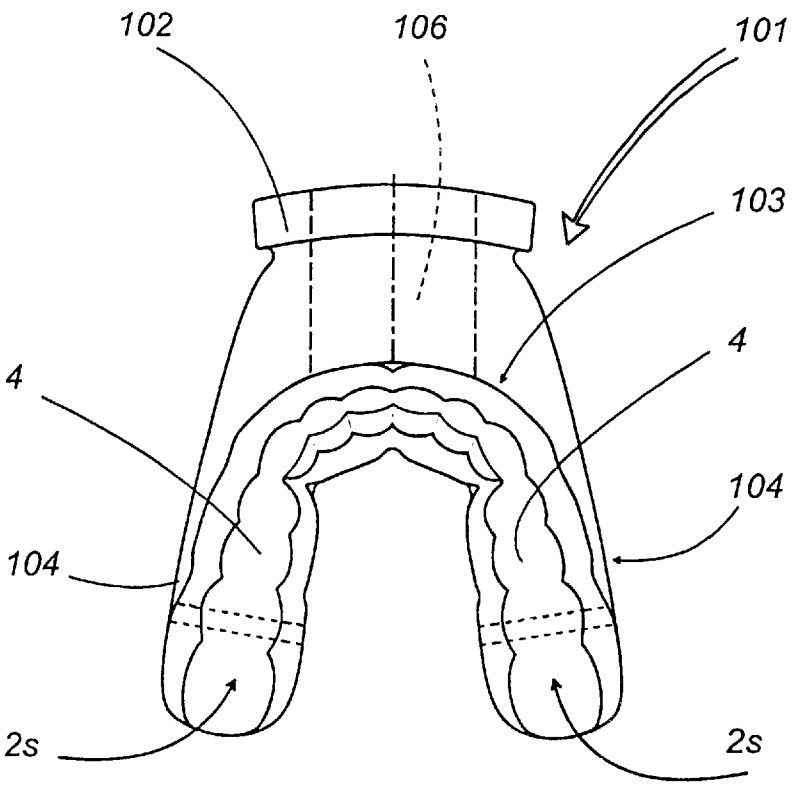
FIGS. 8 and 9 are overall views of a mouthpiece integrating a mouthguard of the type represented in FIGS. 1 and 3 and shown respectively in plan bottom and top view.

According to the figures of the attached drawings, the number 1 indicates in its entirety a mouthguard comprising an arched body 1*a,* made of thermoplastic material (ethylene-vinyl-acetate copolymer) in which are obtained two cavities 2*s,* 2*i* to house an individual's upper and lower dental arches 5, 6 (FIGS. 6 and 7).

The cavities 2*s* and 2*i,* anatomically preformed, are overlaid one on top of the other and are bounded by side walls 3, essentially vertical, connected by a base wall 4, intermediate and transverse with respect to them.

The side walls 3 are shaped towards the interior of the cavities 2*s* and 2*i* with a profile complementing the shape of the average surface of the crown of the natural teeth of a statistically pre-determined set of individuals. The side walls 3 are shaped to present a plurality of arches 31 opposed in pairs and defining, in combination with the base wall 4, a plurality of alveoli 7 each destined to house a single tooth.

The alveoli 7 of the two cavities 2*s* and 2*i*, obtained in vertically corresponding positions, are offset along the development of the body 1*a* arched according to the relative position of the teeth of the invidual arches 5, 6 which corresponds to the anatomic condition of the mandible in an invidual's resting condition.

The side walls 3 of the cavities 2*s* and 2*i* present rounded end edges 8, which are provided with surfaces 8*a* complementing the average gum surface of a pre-determined set of individuals and present interruption areas 9 respectively positioned and shaped to correspond with the frenula and with the discharge area 9*a* of the retroincisor palatal papilla, in order to avoid any possibility of anatomic interference when the mouthguard is worn.

In correspondence with the location of the first molars 12 of each of the two dental arches 5, 6, the arched body 1*a* has two through holes 10 (FIGS. 1, 2 and 3) spanning the thickness of the base wall 4 of the arched body 1*a*, at the two sides of the user's mouth. These holes 10, as shall be understood more clearly in the description below, are provided to perform an important function in controlling the occlusal thickness of the mouthguard 1.

Three analogous through holes 13 are obtained through the side wall 3 of the lower cavity 2*i*, in correspondence with the palatal, papillary and retroincisive area of the user's mouth. These holes 13 serve the obvious purpose of allowing for the passage of air, saliva and voice when the dental arches 5 and 6 are pressed tight on the mouthguard 1.

If the mouthguard 1 is made of a material which can be heat-formed directly by the user, the mouthguard 1 is provided with a device 40 for controlling the thickness of the base wall 4 which corresponds to the desired occlusal space between the user's dental arches 5, 6 (FIGS. 5*a* and 5*b*).

This device 40 comprises a gripping element 14 shaped as an arch with a small central grip 41 and carrying bar-shaped rectilinear distancing elements 11, coplanar with the arch, located in correspondence with opposite ends 41*a* of the arch and projecting towards each other inside the arch itself. The distancing elements 11 are dimensioned to correspond with the through holes 10 of the side wall 3, located in correspondence with the first molars 12.

In correspondence with the grip 41, but towards the interior of the arch, the device 40 comprises three appendices 15 whose shape, size and length complements the through holes 13 of the retroincisor area of the side wall 3 of the arched body 1*a*.

The device 40 is made of elastically flexible plastic material (thermoplastic polyoxymethylene technopolymer) which allows the arch to be manually opened wider by the user so as to insert (and extract) respectively the two distancing elements 11 in the through holes 10 of the arched body 1*a*, located in correspondence with the first molars, and the three appendices 15 in the through holes 13 located in the retroincisor, palatal area of the arched body 1*a*.

After this association, the device 40 positions itself elastically around the arched body 1*a*, surrounding the outermost side wall 3 and allowing to grip and retain the mouthguard 1 simply by holding firmly with two fingers the small grip 41 of the device 40.

To personalise the mouthguard 1 to correspond exactly to the user's dental, labial and gingival anatomy, all that is required is to immerge the mouthguard 1 in hot water for a long enough time to cause the material making up the arched body 1*a* to soften; to support the mouthguard 1 by means of the grip 41 of the device 40 for controlling the occlusal space; to introduce the entire apparatus in one's mouth; to associate the cavities 2*s* and 2*i* to the dental arches 5, 6 taking care to introduce a tooth into each alveolus 7; and finally to tighten the dental arches 5, 6 against each other in the closure position of the mandible.

Figure 8:
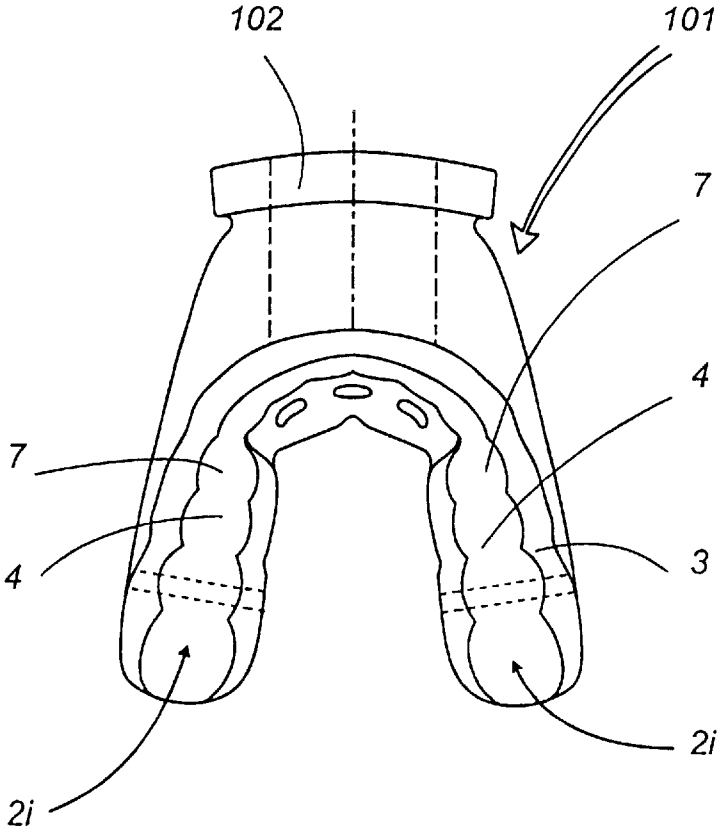

The presence of the distancing elements 11 and of the appendices 13 borne by the arch between the dental arches 5 and 6 prevents the possible excessive tightening of the teeth during the personalisation phase from bringing about an excessive reduction in the thickness of the occlusal buffer provided by the base wall 4 or an excessive reduction in the through section of the holes 13 which are instead located in the side wall 3 in correspondence with the user's palatal, papillary, retroincisor. FIGS. 7 and 8 show a variation in the embodiment of the mouthguard 1 in which the mouthguard 1 is integrated in a single body in a mouthpiece for underwater breathing indicated in its entirety as 101. The mouthpiece 101 is made of rubbery material, which can be personalised with heat as previously described and comprises a manifold 102, a retention element 103 and two support inserts 104.

The manifold 102 has a hole 106 through it, and it is destined to fasten the retention element 103 to the breathing apparatus (not shown). The retention element 103 has a hole at its centre to allow for air passage and it is inserted between lips and teeth.

The support inserts 104 extend in the intra-oral direction and comprise a base wall 4 bounded by anatomically preformed side walls 3 which jointly define cavities 2*s*, 2*i* wholly similar to those shown in the previous FIGS. 1, 2 and 3.

After personalisation by the user, the cavities 2*s*, 2*i* interpose themselves between the dental arches 5, 6, completely encompassing them so as to provide a gripping space which, being perfectly matched to the morphology of the mouth, allows the mouthpiece 101 to remain set in a stable position, in the resting condition of the mandible, requiring nearly nil tightening effort on the part of the user.

FIGS. 8 and 9 also show that the development of the cavities 2*s* and 2*i* in the intra-oral direction is limited to the areas of the dental arches 5 and 6 which extend between the first premolar and the second molar. Therefore, what has previously been stated about the technical characteristics shown in the previous FIGS. 1, 2, 3 and 4 also applies to the mouthpiece 101.

With regard to personalisation of the mouthpiece 101 and, in particular, to the dimensioning of the occlusal thickness, what has been stated previously applies, except for the obvious shape modifications to be made to the limiter device 40 in FIG. 5*a*, to make its geometry and size compatible with the mouthpiece 101 in the FIGS. 8 and 9.

The invention thus conceived may be subject to numerous modifications and variations without thereby departing from the scope of the inventive concept. Moreover, all components may be replaced with technically equivalent elements.

What is claimed is:

1. A mouthguard for the prevention of oro-maxillo-facial traumas to a user thereof, said mouthguard comprising:

an upper and a lower cavity for housing a respective upper and lower dental arch of said user, each said cavity bounded by common outer and inner side walls connected to an intermediate and common base wall, wherein each said cavity is respectively anatomically preformed with a profile complementary to the shape of the average surface of the natural teeth of a statistically pre-determined set of individuals, said profile formed into each cavity outer and inner side wall.

2. The mouthguard or mouth-piece according to claim 1, comprising two said cavities preformed to house respectively the upper and lower dental arches of an individual.

3. The mouthguard or mouth-piece according to claim 2, wherein the cavities are shaped according to the relative position of the teeth of the individual arches corresponding to the individual's resting condition.

4. The mouthguard or mouth-piece according to claim 3, wherein said at least one cavity is provided with a plurality of alveoli, each of which is destined to house a single tooth.

5. The mouthguard or mouth-piece according to claim 1, wherein said at least one cavity is provided with a plurality of alveoli, each of which is destined to house a single tooth.

6. The mouthguard or mouth-piece according to claim 1, wherein the side walls present end edges which in turn present surfaces complementing the shape of the average gingival surfaces of a statistically predetermined set of individuals.

7. The mouthguard or mouth-piece according to claim 6, wherein the end edges of the side walls are provided with interruption areas positioned and shaped to complement the frenula of a statistically pre-determined set of individuals.

8. The mouthguard or mouth-piece according to claim 7, wherein it comprises at least one through hole, running through the base wall of said one or each cavity and able to house at least one element for distancing the dental arches when the user tightens his/her teeth.

9. The mouthguard or mouth-piece according to claim 8, wherein the hole is located in correspondence with the user's first molars.

10. The mouthguard or mouth-piece according to claim 8, wherein said one or each distancing element is borne at one end of a manual gripping element of the mouthguard.

11. The mouthguard or mouth-piece according to claim 10, wherein the gripping element is shaped to surround the side walls of said one or each cavity and it can be opened wider for introducing and extracting said one or each distancing element into and from the respective housing holes.

12. The mouthguard or mouth-piece according to claim 10, wherein the gripping element is provided with appendices which can be inserted in the holes opposite the user's papillary, palatal area.

13. The mouthguard or mouth-piece according to claim 1, wherein it is made of material which can be heat-moulded directly by the user.

14. The mouthguard or mouth-piece according to claim 13, wherein the holes are two and are respectively located on the two sides of the user's mouth.

15. The mouthguard or mouth-piece according to claim 1, comprising three through holes running through at least one side wall, located in correspondence with the papillary, palatal, retroincisor area of the user's mouth.

16. Mouthguard or mouth-piece provided with a device for limiting the occlusal thickness comprising at least one element for distancing the dental arches and a manual gripping element bearing said one or each distancing element, said device allowing to interpose said one or each distancing element between the user's dental arches in such a way as to bound an occlusal space of a pre-determined breadth in correspondence with teeth closure.

17. The mouthgard or mouth-piece according to claim 16, wherein said one or each distancing element is bar-shaped.

18. The mouthgard or mouth-piece according to claim 16, wherein the gripping element is made of elastically flexible material.

19. The mouthgard or mouth-piece according to claim 16, wherein said device also comprises three appendices borne by the gripping element projecting towards the user's papillary, palatal, retroincisor area.

* * * * *